US006026748A

United States Patent [19]

Reed et al.

[11] Patent Number: 6,026,748

[45] **Date of Patent: *Feb. 22, 2000**

[54] INFRARED DRYER SYSTEM FOR PRINTING PRESSES

[75] Inventors: Timothy R. Reed, Woodridge; William J. Meyer, Lombard; Michael Van Epps, Oak Park; Dennis Hermann, Palatine, all of Ill.

[73] Assignee: Oxy-Dry Corporation, Itasca, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/967,394

[22] Filed: Nov. 11, 1997

[51] Int. Cl.[7] ..... F26B 3/30

[52] U.S. Cl. ..... 101/424.1; 392/417; 219/388; 34/273; 34/267; 101/488

[58] Field of Search ..... 392/417; 219/388; 101/424.1, 488; 34/266, 273, 267, 268, 269

[56] References Cited

U.S. PATENT DOCUMENTS

| | | | |
|---|---|---|---|
| 3,249,741 | 5/1966 | Mills | 219/388 |
| 4,408,400 | 10/1983 | Colapinto | 219/388 |
| 4,501,072 | 2/1985 | Jacobi, Jr. et al. | 101/488 |
| 4,809,608 | 3/1989 | Wolnick et al. | 101/487 |
| 4,841,903 | 6/1989 | Bird | 101/217 |
| 4,939,992 | 7/1990 | Bird | 101/488 |
| 5,132,519 | 7/1992 | Jackson et al. | 219/388 |
| 5,317,127 | 5/1994 | Brewster, Jr. et al. | 219/388 |
| 5,323,485 | 6/1994 | Josefsson et al. | 219/388 |
| 5,383,403 | 1/1995 | Nordvall | 101/424.1 |
| 5,440,821 | 8/1995 | Hamrin | 34/273 |
| 5,496,406 | 3/1996 | Beisswanger et al. | 34/273 |
| 5,537,925 | 7/1996 | Secor et al. | 101/424.1 |
| 5,727,472 | 3/1998 | Burgio | 101/424.1 |
| 5,832,833 | 11/1998 | Burgio | 101/424.1 |

*Primary Examiner*—John Hilten
*Assistant Examiner*—Leslie J. Grohusky
*Attorney, Agent, or Firm*—Leydig, Voit & Mayer, Ltd.

[57] ABSTRACT

A printing press having a plurality of laterally spaced printing stations is provided with an interstation dryer system, interposed between the printing stations, for effectively drying liquid printing substances, such as inks, coatings, and the like, on a moving printed sheet. The dryer system includes a plurality of infrared elements which are adapted to transmit infrared radiation toward the moving printed sheet to effectuate drying of liquid printing substances thereon and bonding thereto. In order to effectively dry a complete spectrum of ink colors and other liquid printing substances, the infrared elements comprise an alternating and repetitive series of shortwave infrared lamps and mediumwave infrared lamps which generate relatively short wavelength infrared radiation and relatively medium wavelength infrared radiation, respectively.

25 Claims, 2 Drawing Sheets

INFRARED DRYER SYSTEM FOR PRINTING PRESSES

FIELD OF THE INVENTION

The present invention relates generally to drying liquid printing substances applied to sheets in printing presses and, more particularly, to a dryer system adapted for use in multiple station printing presses for effective drying of sheets having inks, coatings, and/or other liquid printing substances applied thereto.

BACKGROUND OF THE INVENTION

It is known in the art of printing to provide interstation dryers which direct hot forced air against moving printed sheets between successive printing and/or coating stations, such as those disclosed in U.S. Pat. Nos. 4,841,903 and 4,939,992. A major disadvantage of such systems is that during high-speed printing operations it is not possible to achieve complete interstation drying of liquid printing substances—such as inks, coatings, and the like—on the quickly moving printed sheets. As such, the printed sheets frequently have non-dried inks and/or coatings thereon as they enter the next printing and/or coating station which adversely affects the application of liquid printing substances at the next station. Indeed, unless the liquid printing substances on the passing printed sheets are sufficiently dried before entering the next station, unwanted blemishes, such as voids, uneven tones, and ragged edges, may result on the printed sheets. In addition, because of severe space limitations in such systems, other forms of interstation dryers have been deemed unsuitable.

OBJECTS AND SUMMARY OF THE INVENTION

Accordingly, a general object of the present invention is to provide an interstation dryer system for printing presses which effectively dries liquid printing substances, such as inks and/or coatings, on passing printed sheets during high-speed printing operations.

A more specific object of the invention is to provide an interstation dryer system for printing presses which effectively dries a complete spectrum of ink colors and/or coatings on passing printed sheets during high-speed printing operations.

A related object of the invention is to provide an interstation dryer system for printing presses which effectively bonds inks, coatings, and other liquid printing substances to passing printed sheets during high-speed printing operations.

A further object of the invention is to provide an interstation dryer system for printing presses which substantially eliminates the formation of unwanted blemishes on passing printed sheets during high-speed printing operations.

Another object of the invention is to provide an interstation dryer system as characterized above which is relatively compact in design, and which lends itself to utilization in confined areas between successive printing and/or coating stations.

An additional object of the invention is to provide an interstation dryer system of the foregoing type which is relatively simple and economical in construction, and which lends itself to reliable operation and use.

These and other objects, features, and advantages of the invention will become more readily apparent upon reading the following detailed description of the preferred embodiment, and upon reference to the accompanying drawings wherein:

Figure 1:
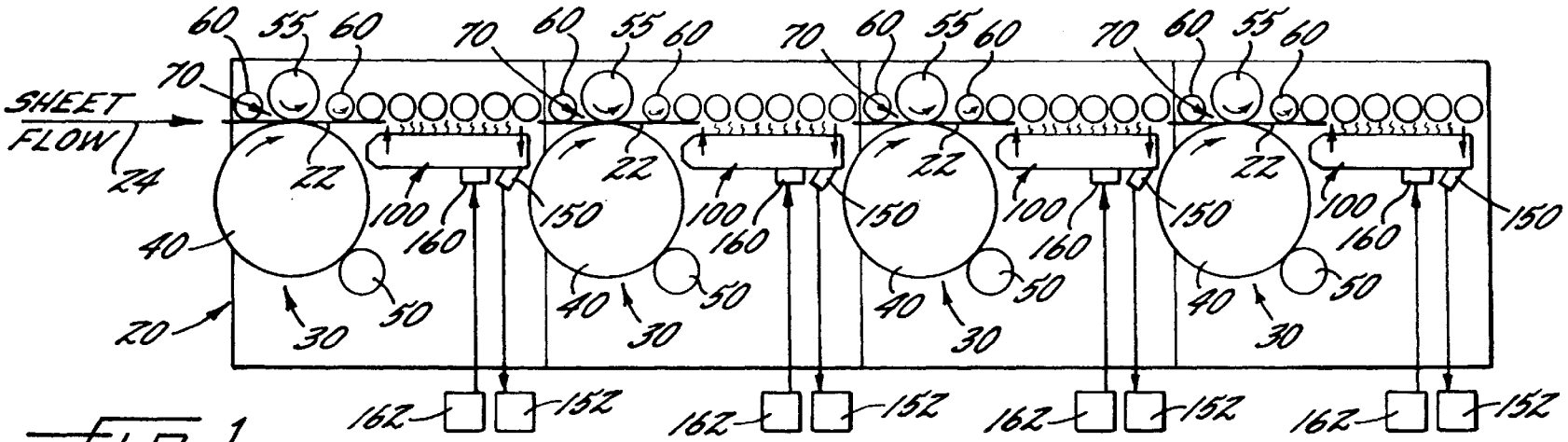
FIG. 1 is a partially diagrammatic side elevational view of an illustrative in-line printing press having a plurality of laterally spaced printing stations and interstation dryer systems constructed in accordance with the present invention.

While the invention is susceptible to various modifications and alternative constructions, a certain illustrated embodiment thereof has been shown in the drawings and will be described in detail below. It should be understood, however, that there is no intention to limit the invention to the disclosed structural forms. On the contrary, the intention is to cover all modifications, alternative constructions, and equivalents that fall within the spirit and scope of the invention as defined by the appended claims. Hence, while the invention will be described in connection with an in-line printing press, it will be understood that the invention is equally applicable to other forms of printing.

DETAILED DESCRIPTION OF THE PREFERRED EMBODIMENT

Referring now more particularly to FIG. 1 of the drawings, there is shown an illustrative printing press 20 embodying the present invention which, in this case, is an in-line printing press having a plurality of laterally spaced printing stations 30. As is customary in the art, each printing station 30 includes a rotary plate cylinder 40 to which a printing plate is attached, a metering roller 50 which supplies either a specific color of ink or a coating to the plate cylinder 40, and a impression cylinder 55 which cooperates with the plate cylinder 40 to form a nip 70 therebetween. The printing press 20 also includes a plurality of aligned transfer rollers 60 which are arranged above the printing stations 30 on either side of the impression cylinders 55. As used herein, the term "printing station" is intended to include a unit within a printing press 20 where a liquid printing substance, such as an ink, a coating, or the like, is applied to sheets or substrates 22 of printable material, such as paper, cardboard blanks, and the like.

At each printing station 30, the sheets 22 are received by the nip 70 formed between the upper impression cylinder 55 and the lower plate cylinder 40 while the impression cylinder 55 and the plate cylinder 40 rotate in opposite directions (i.e., in a counterclockwise direction and a clockwise direction, respectively, as viewed in FIG. 1) to move the sheets 22 along the printing press 20 in a sheet flow direction 24. When the sheets 22 are between printing stations 30 and no longer supported by one of the plate cylinders 40, however, an external vacuum source provided above and along the full length of the printing press 20 keeps the sheets 22 in frictional contact with the transfer rollers 60 while rotation of the transfer rollers 60 moves the sheets 22 toward the next downstream printing station 30. Of course, in order to move the sheets 22 at a substantially uniform rate through the printing press 22, the tangential velocity of the outer surface of the transfer rollers 60 should be substantially equal to the tangential velocity of the outer surface of each impression cylinder 55.

As sheets 22 pass between the upper impression cylinder 55 and the lower plate cylinder 40 of one of the printing stations 30, the printing plate of the plate cylinder 40 applies an inked image onto the sheets 22. In multi-color printing operations, a different color ink is applied to the sheets 22 at each printing station 30. In fact, as the sheets 22 pass through the printing stations 30, a series of different colored inks can be applied over the same areas of the sheets 22 to produce multi-colored images having a variety of desired colors and/or color blends. Alternatively, a coating can be applied at one or more of the printing stations 30 to provide a protective or aesthetic coating over the printed areas of the sheets 22. Typical coating compositions include, for example, aqueous solutions, dispersions, and emulsions of water dispersible or water-soluble film-forming binder materials, such as acrylic resins, hydrophillic colloids, vinyl alcohol, and the like. In most multi-color printing operations, the coating is substantially clear or transparent and is applied at the last or final printing station 30 (i.e., the rightwardmost printing station 30, as viewed in FIG. 1).

In accordance with the present invention, interstation dryer systems 100 are interposed between printing stations 30, each of which includes a plurality of infrared heating/drying elements 110 for transmitting infrared (IR) radiation to the moving printed sheets 22 to effectuate quick and efficient heating and drying of liquid printing substances (e.g., inks, coatings, and the like) thereon and bonding thereto during high-speed operation of the printing press 20. To this end, each interstation dryer system 100 comprises a relatively compact housing or cabinet 120 which supports the infrared elements 110 in relatively close proximity to the moving printed sheets 22. On account of this novel construction, the interstation dryer systems 100 provide extremely rapid heating and drying of liquid printing substances on the sheets 22 and bonding thereto even when the sheets 22 are moving quickly between successive printing stations 30. More specifically, the liquid printing substances on these quickly moving sheets 22 are dry-trapped by the infrared radiation provided by the heating/drying elements 110 prior to entering the next printing station 30. Such dry-trapping provides suitable ink bonding to the sheets 22 which enables the sheets 22 to hold a truer color and eliminates the formation of unwanted blemishes on the sheets 22 during subsequent printing operations at downstream printing stations 30.

In carrying out an important aspect of the present invention, the infrared elements 110 are specifically adapted to generate distinctly different wavelengths of infrared radiation to more effectively dry a complete spectrum of ink colors, coatings, and other liquid printing substances. In the illustrated embodiment, the infrared elements 110 comprise an alternating and repetitive series of shortwave and mediumwave infrared lamps 112 and 114 which generate relatively short wavelength and relatively medium wavelength infrared radiation, respectively. As is known in the art, lighter ink colors have a tendency to reflect relatively short wavelength infrared radiation. In addition, relatively short wavelength infrared radiation is more intense than relatively medium wavelength infrared radiation and penetrates deeper into the sheets 22. As such, the relatively short wavelength infrared radiation generated by the shortwave infrared lamps 112 is particularly effective for penetrating the sheets 22 and for heating and drying darker ink colors on the surface thereof while the relatively medium wavelength infrared radiation generated by the mediumwave infrared lamps 114 is particularly effective for heating and drying lighter ink colors and clear coatings on the surface of the sheets 22. Hence, through operation of this alternating and repetitive series of shortwave and mediumwave infrared lamps 112 and 114, a complete spectrum of ink colors, coatings, and other liquid printing substances can be effectively dried onto the sheets 22 and bonded thereto as the sheets 22 move between successive printing stations 30.

Infrared radiation is a specific type of electromagnetic radiation which falls within a known wavelength spectrum. In particular, electromagnetic radiation having a wavelength ranging between 0.72 and 1000 micrometers (or microns) is considered infrared radiation. For the purpose of defining relatively short and relatively medium wavelength infrared radiation herein, at least eighty percent of the relatively short wavelength infrared radiation generated by the shortwave infrared lamps 112 should fall between 0.72 microns and 1.50 microns and at least eighty percent of the relatively medium wavelength infrared radiation generated by the mediumwave infrared lamps 114 should fall between 1.50 microns and 5.60 microns. In the presently preferred embodiment, the shortwave infrared lamps 112 generate a peak wavelength of 1.17 microns at a peak operating power of 1000 Watts while the mediumwave infrared lamps 114 generate a peak wavelength of 2.27 microns at a peak operating power of 700 Watts.

Figure 2:
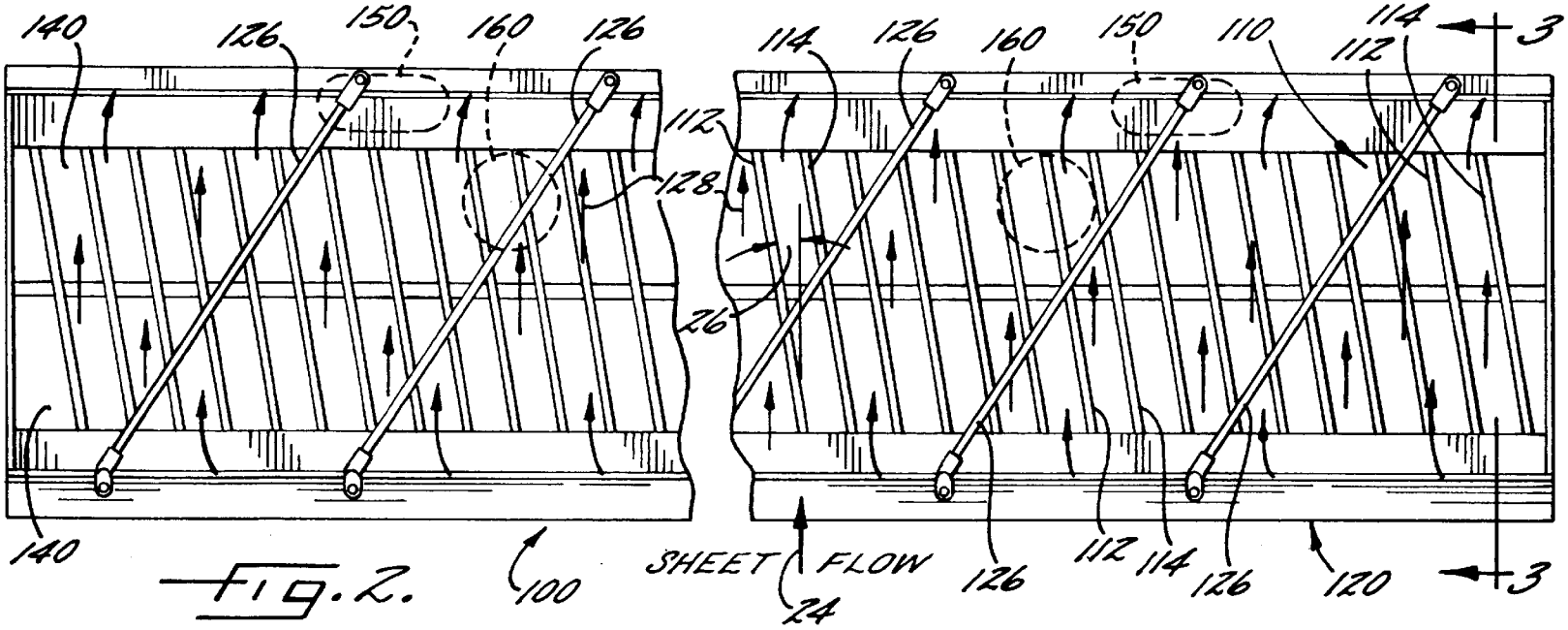
FIG. 2 is a partially fragmentary top plan view of one of the interstation dryer systems depicted in FIG. 1.

In order to ensure that all sections of the sheets 22 receive both relatively short wavelength infrared radiation and relatively medium wavelength infrared radiation as they pass between successive printing stations 30, each shortwave and mediumwave infrared lamp 112 and 114 is arranged at a slight angle with respect to sheet flow direction 24, as indicated by reference numeral 26 in FIG. 2. By virtue of this arrangement, each shortwave and mediumwave infrared lamp 112 and 114 transmits infrared radiation over a greater width of the sheets 22 than if these lamps 112 and 114 were arranged parallel to the sheet flow direction 24. This arrangement also causes the shortwave and mediumwave infrared lamps 112 and 114 to transmit relatively short wavelength and relatively medium wavelength infrared radiation in an overlapping manner as the sheets 22 move between successive printing stations 30.

Figure 3:
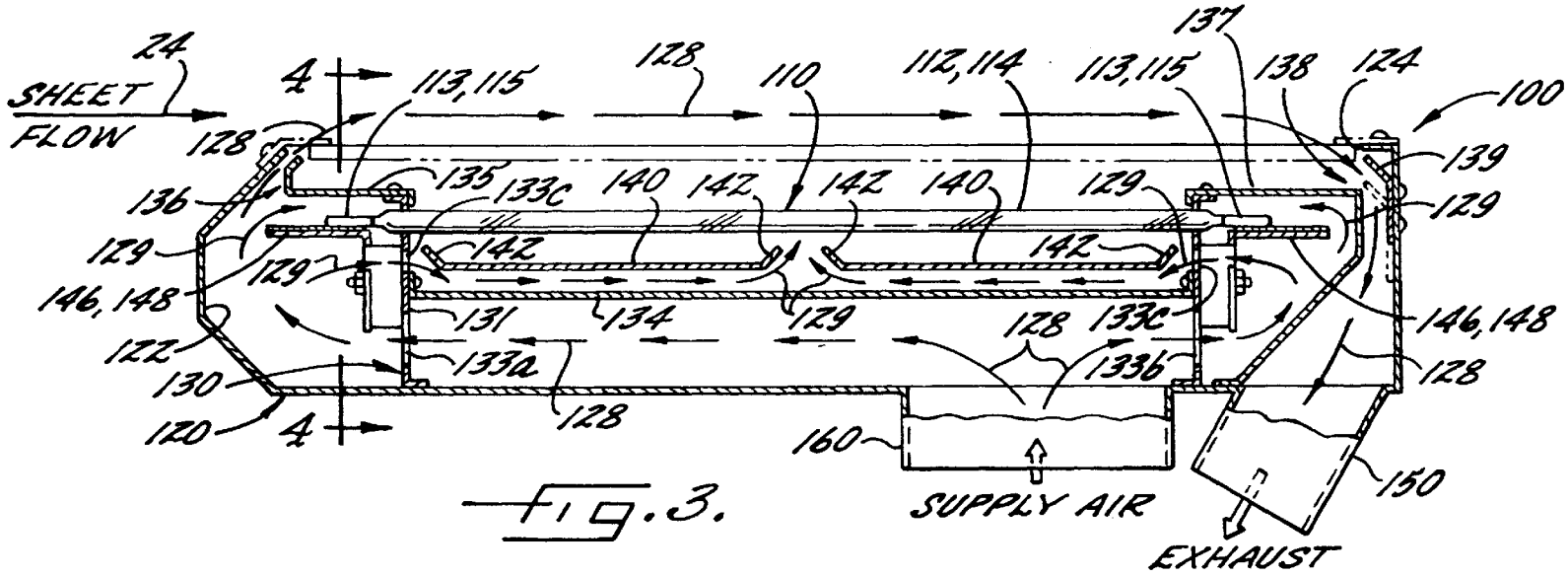
FIG. 3 is an enlarged cross-sectional view taken along line 3—3 of FIG. 2.

In the illustrated embodiment, the cabinet 120 of each interstation dryer system 100 is formed of sheet metal construction which defines an interior chamber 122 and includes an internal support structure 130 which retains the shortwave and mediumwave infrared lamps 112 and 114 in a substantially horizontal manner. The cabinet 120 also includes a substantially open top portion 124 which is arranged between the moving printed sheets 22, as defined by sheet flow direction 24, and the shortwave and mediumwave infrared lamps 112 and 114. In order to protect the lamps 112 and 114 from falling sheets 22 and other debris, a plurality of substantially parallel cross-members 126 extend across the open top portion 124 of the cabinet 120 at an angle with respect to sheet flow direction 24, as shown in FIG. 2. A pair of spaced-apart reflector pans 140 are also mounted beneath the shortwave and mediumwave infrared lamps 112 and 114, as shown in FIG. 3, to advantageously reflect infrared radiation back toward the moving printed sheets 22.

Figure 4:
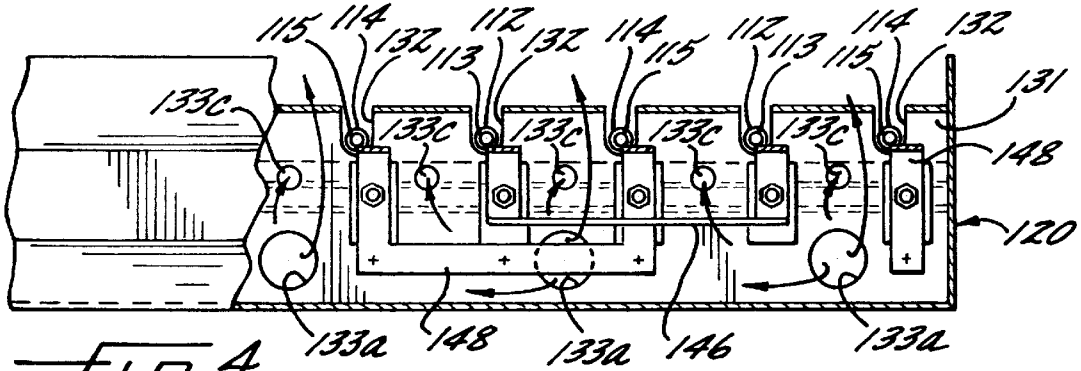
FIG. 4 is a partially fragmentary cross-sectional view taken along line 4—4 of FIG. 3.

The internal support member 130 of cabinet 120 includes a pair of opposed and generally vertical frame members 131 which are connected by a generally horizontal frame member 134. As best shown in FIG. 4, the opposed ends of the shortwave and mediumwave infrared lamps 112 and 114 are received by and supported within a plurality of spaced-apart slots 132 formed in the opposed vertical frame members 131. In addition, a plurality of the shortwave infrared lamps 112 are electrically coupled at their terminal ends 113 by a first solid state junction 146. Likewise, a plurality of the mediumwave infrared lamps 114 are electrically coupled at their terminal ends 115 by a second solid state junction 148.

During the heating and drying of liquid printing substances on the passing printed sheets 22, a significant amount of moisture evaporates therefrom which causes humidity or moisture-laden air to build-up between the printing stations 30. In order to evacuate this moisture-laden air, the cabinet 120 includes at least one exhaust port 150 which is coupled to and communicates with an exhaust or suction pump 152, as shown in FIG. 1. While the specific printing application and operating environment inevitably dictate the size and operating characteristics of the suction pump 152, in every printing application the suction pump 152 should have enough power or capacity to provide a desired air flow rate through the exhaust port 150.

In keeping with another important aspect of the present invention, a continuous supply of relatively dehydrated replacement or make-up air is directed into the interior chamber 122 of the cabinet 120 to facilitate the evacuation of moisture-laden air from between the printing stations 30. To this end, ambient pressurized air from a relatively dehydrated external environment, such as plant air, is supplied between the printing stations 30 through at least one inlet port 160 of the cabinet 120. As depicted in FIG. 1, the inlet port 160 is coupled to and communicates with an inlet or supply pump 162 which advantageously replenishes the moisture-laden air evacuated by the suction pump 152 with relatively dehydrated make-up air. Like the suction pump 152, the supply pump 162 should have enough power to provide a desired replenishing air flow rate through the inlet port 150.

The combined action of the suction pump 152 and the supply pump 162 causes a flow of air through the cabinet 120 from the inlet port 160 to the exhaust port 150, as indicated by reference numeral 128, which facilitates the evacuation of moisture-laden air from between the printing stations 30. Because the outlet port 150 of the illustrated embodiment is located downstream of the inlet port 160, as viewed in the sheet flow direction 24, this air flow 128 proceeds in a substantially identical direction as the sheet flow direction 24 at the open top portion 124 of the cabinet 120, as shown in FIG. 3. Notwithstanding this characterization, it will be readily appreciated by those skilled in the art that this air flow 128 may be reversed at the open top portion 124 of the cabinet 120 so that it proceeds in a substantially opposite direction as the sheet flow direction 24 simply by installing the outlet port 150 upstream of the inlet port 160, as viewed in the sheet flow direction 24 (i.e., by rotating the cabinet 120 one-hundred and eighty degrees).

As best shown in FIG. 3, the internal support structure 130 of the cabinet 120 includes first and second cover portions 135 and 137 which are mounted to the opposed vertical frame members 131 to provide air flow slots 136 and 138 at opposite ends of the open top portion 124. In usage, the air flow 128 is advantageously directed through slot 136 and against the passing printed sheets 22, as indicated by the sheet flow direction 24, to more effectively remove moisture-laden air from between the printing stations 30. An adjustable exhaust damper 139 is also provided at slot 138 which permits the air flow 128 through the cabinet 120 to be conveniently controlled or regulated on an as-needed basis. On account of this construction, the air flow 128 proceeds from the inlet port 160, through a series of lower apertures 133*a* formed in the left vertical frame member 131 of the internal support structure 130, through slot 136, against the passing printed sheets 22, through slot 138, and finally through the outlet port 150.

In order to increase the longevity of the infrared elements 110, some of this air flow 128 is diverted against the terminal ends 113 and 115 of the shortwave and mediumwave infrared lamps 112 and 114, as indicated by reference numeral 129 in FIG. 3. On the left-hand side of the cabinet 120, for example, the diverted air flow 129 splits off from the main air flow 128 in the vicinity of the solid state junctions 146 and 148 and then passes over the terminal ends 113 and 115 of the shortwave and mediumwave infrared lamps 112 and 114. On the right-hand side of the cabinet 120, conversely, the diverted air flow 129 splits off from the main air flow 128 near the inlet port 160, proceeds through lower apertures 133*b* formed in the right vertical frame member 131, and then passes over the terminal ends 113 and 115 of the shortwave and mediumwave infrared lamps 112 and 114. In this way, the diverted air flow 129 provides suitable convection cooling of the opposed terminal ends 113 and 115 of the shortwave and mediumwave infrared lamps 112 and 114.

In order to limit thermal expansion and warpage of the reflector pans 140, this diverted air flow 129 is also directed through a series of upper apertures 133*c* formed in the left and right vertical frame members 131 for expulsion between the reflector pans 140 and the horizontal frame member 134. Thereafter, this diverted air flow 129 is discharged through opposed angled end portions 142 of the reflector pans 140 for re-combination with the main air flow 128 at the open top portion 124 of the cabinet 120. In this way, the diverted air flow 129 also provides suitable convection cooling of the reflector pans 140.

While the present invention has been described and disclosed in connection with an illustrated embodiment, it will be understood, of course, that there is no intention to limit the invention to the disclosed structural forms. On the contrary, the intention is to cover to cover all modifications, alternative constructions, and equivalents that fall within the scope and spirit of the invention as defined by the following claims.

What is claimed is:

1. A printing press comprising:

a plurality of laterally spaced printing stations;

an interstation dryer system interposed between a pair of said printing stations for drying liquid printing substances on a printed sheet as the sheet is moving along a line of travel between said printing stations, said interstation dryer system having a plurality of elongated infrared elements in spaced relation to said printed sheet for transmitting infrared radiation toward the moving printed sheet to effectuate drying of liquid printing substances thereon and bonding thereto, said elongated infrared elements extending generally parallel to the line of travel of the printed sheet, and said dryer system including an air handling system having an air inlet passageway for delivering air directly into a space between the printed sheet and the elongated infrared elements adjacent one longitudinal end of said elongated infrared elements and an air outlet passageway for drawing air from the space between the printed sheet and the elongated infrared elements adjacent an opposite longitudinal end of said elongated infrared elements, said air handling system being operable such that substantially all of an air flow through the space between the printed sheet and the infrared elements is produced by air directed through said air inlet passageway and drawn out of said air outlet passageway so as to create an air flow path between said elongated infrared elements and said printed sheet substantially along the length of said elongated infrared elements from one end to the opposite end.

2. The invention set forth in claim 1, wherein the infrared elements comprise an alternating and repetitive series of shortwave infrared lamps and mediumwave infrared lamps which are simultaneously operable to generate relatively short wavelength infrared radiation and relatively medium wavelength infrared radiation, respectively, to effectively dry a complete spectrum of liquid printing substances.

3. The invention set forth in claim 1 in which said elongated infrared elements are oriented at a small acute angle to the line of sheet travel.

4. The invention set forth in claim 1 including a vacuum pump coupled to said air outlet passageway for drawing air flow inwardly through said outlet passageway.

5. The invention set forth in claim 1 including a blower for directing air flow outwardly through said inlet passageway.

6. The invention set forth in claim 1, wherein the interstation dryer system includes a cabinet which supports the infrared elements, the cabinet having a substantially open top portion.

7. The invention set forth in claim 6, wherein the substantially open top portion of the cabinet is arranged between the infrared elements and the moving printed sheet.

8. The invention set forth in claim 7, wherein the cabinet includes at least one reflector pan mounted beneath the infrared elements for reflecting infrared radiation back toward the moving printed sheet.

9. The invention set forth in claim 1 including a vacuum pump coupled to said air outlet passageway for drawing air flow inwardly through said outlet passageway, and a blower for directing air flow outwardly through said inlet passageway.

10. The invention set forth in claim 1, wherein said air flow between said air inlet passageway and outlet passageway is substantially in the direction of sheet travel.

11. The invention set forth in claim 1, wherein said air flow between said air inlet passageway and air outlet passageway is opposite the direction of sheet travel.

12. A printing press comprising:

a plurality of laterally spaced printing stations;

an interstation dryer system interposed between a pair of said printing stations for drying liquid printing substances on a printed sheet moving between said printing stations along a line of travel, said interstation dryer system having a plurality of infrared elements which are adapted to transmit infrared radiation toward the moving printed sheet, said infrared elements extending generally parallel to the line of travel of the printed sheet and including a first series of shortwave infrared lamps for generating relatively short wavelength infrared radiation and a second series of medium-wave infrared lamps for generating relatively medium wavelength infrared radiation, said first and second series of infrared lamps being simultaneously operable such that said first series of lamps generate shortwave length infrared radiation and said second series of lamps simultaneously generate medium wavelength infrared radiation whereby said first and second series of infrared lamps effectuate rapid drying of a complete spectrum of liquid printing substances during sheet travel between said printing stations, and said dryer system including an air handling system having an air inlet passageway for directing air directly to an area of the infrared elements and the printed sheet adjacent one longitudinal end of said infrared elements and an air outlet passageway for drawing air from the area of the infrared elements and the printed sheet adjacent an opposite longitudinal end of said infrared elements, said air handling system being operable such that substantially all of an air flow past said infrared elements is produced by air directed through said air inlet passageway and drawn out of said air outlet passageway so as to create an air flow path substantially along the length of said infrared elements from one end to the opposite end.

13. The invention set forth in claim 12, wherein at least eighty percent of the relatively short wavelength infrared radiation generated by the shortwave infrared lamps is between 0.72 micrometers and 1.50 micrometers.

14. The invention set forth in claim 12, wherein at least eighty percent of the relatively medium wavelength infrared radiation is between 1.50 micrometers and 5.60 micrometers.

15. The invention set forth in claim 12, wherein each shortwave and mediumwave infrared lamp is arranged at a uniform angle with respect to sheet flow direction.

16. The invention set forth in claim 12 wherein said infrared elements comprise an alternating and repetitive series of said shortwave infrared lamps and mediumwave infrared lamps.

17. The invention set forth in claim 12 in which said infrared elements are disposed at an acute angle to the line of sheet travel.

18. The invention set forth in claim 12, wherein said interstation dryer system includes a cabinet which supports the infrared elements, said cabinet including an exhaust port which is coupled to an exhaust pump for removing moisture-laden air from between the printing stations.

19. The invention set forth in claim 18, wherein the cabinet includes an inlet port which is coupled to a supply pump for replenishing the moisture-laden air removed from the cabinet by the exhaust pump with relatively dehydrated air.

20. The invention set forth in claim 19, wherein the supply pump and the exhaust pump interact to cause a flow of air through the cabinet from the inlet port toward the exhaust port.

21. The invention set forth in claim 20, wherein at least some of the flow of air through the cabinet is directed at the moving printed sheet.

22. The invention set forth in claim 21, wherein the cabinet includes a substantially open top portion.

23. The invention set forth in claim 22, wherein the flow of air at the substantially open top portion of the cabinet proceeds in a substantially identical direction as the moving printed sheet.

24. The invention set forth in claim 22, wherein the flow of air at the substantially open top portion of the cabinet proceeds in a substantially opposite direction as the moving printed sheet.

25. The invention set forth in claim 20, wherein at least some of the flow of air through the cabinet is diverted over opposed ends of the infrared elements to provide convection cooling thereof.

* * * * *